US008371616B2

(12) United States Patent
Wu et al.

(10) Patent No.: US 8,371,616 B2
(45) Date of Patent: Feb. 12, 2013

(54) FALSE POSITIVE TESTING DEVICE

(76) Inventors: Judy Wailing Wu, Markham (CA); Robert Andrew McTaggart, Markham (CA)

( * ) Notice: Subject to any disclaimer, the term of this patent is extended or adjusted under 35 U.S.C. 154(b) by 408 days.

(21) Appl. No.: 12/317,320

(22) Filed: Dec. 22, 2008

(65) Prior Publication Data

US 2009/0243280 A1 Oct. 1, 2009

Related U.S. Application Data

(60) Provisional application No. 61/006,161, filed on Dec. 26, 2007, provisional application No. 61/011,760, filed on Jan. 22, 2008, provisional application No. 61/063,367, filed on Feb. 4, 2008, provisional application No. 61/065,255, filed on Feb. 11, 2008.

(51) Int. Cl.
*B42D 15/00* (2006.01)

(52) U.S. Cl. ..... 283/95

(58) Field of Classification Search ..... 283/85, 283/95; 428/29, 916; 503/200, 201, 206
See application file for complete search history.

(56) References Cited

U.S. PATENT DOCUMENTS 4,985,340 A * 1/1991 Palazzotto et al. ..... 430/270.1
5,063,163 A * 11/1991 Carmeli ..... 436/94
6,214,766 B1 * 4/2001 Kurrle ..... 503/201
6,666,991 B1 * 12/2003 Atarashi et al. ..... 252/301.4 R
7,157,505 B2 * 1/2007 Sugerman ..... 523/161
2005/0106363 A1 * 5/2005 Williams et al. ..... 428/195.1
2010/0059984 A1 * 3/2010 Domanski et al. ..... 283/91

OTHER PUBLICATIONS

Eldred, Dr. Nelson R.; Chemistry for the Graphic Arts, Third Edition; Feb. 2001, pp. 143 and 281.*

Eldred, Nelson R., "Chemistry for the Graphic Arts," Second Edition, ISBN: 0-88362-149-5, pp. 237 & 245, PIAGATF Press—Sewickley, PA, (1992).

Renesse, Rudolf L. van, "Optical Document Security," Second Edition, ISBN: 0-89006-982-4, pp. 117-124, Artech House, Boston—London, (1998).

Technical Data Sheet—"Pen Reactive Inks," Dry/Offset/Letterpress-SICPA Securinx Corp., 8000 Research Way, Springfield, VA., 22153 (2006).

* cited by examiner

*Primary Examiner* — Lesley D Morris
*Assistant Examiner* — Christopher E Veraa
(74) *Attorney, Agent, or Firm* — Grossman, Tucker, Perreault & Pfleger, PLLC

(57) ABSTRACT

A false positive testing device (FPTD) that contains a coating based on a one hundred percent solids varnish and a transparent reagent, that uses oxidative free radical polymerization as a drying mechanism, and that can be transferred to various types of porous substrates by conventional lithographic offset printing and/or dry offset printing. The substrates with the FPTD can be verified by using common currency detection protocols, such as testing with ultraviolet lights and/or counterfeit detection iodine based pen/pad stamps.

9 Claims, 9 Drawing Sheets

FALSE POSITIVE TESTING DEVICE

CROSS-REFERENCE TO RELATED APPLICATION

This application claims priority based upon provisional patent application No. 61/006,161, filed on Dec. 26, 2007, for "Methods and Ways of Producing Secure Documents and Financial Instruments using False Positive Testing and Verification." The entire disclosure of this provisional application is hereby incorporated by reference into this specification.

This application also claims priority based upon provisional patent application No. 61/011,760, filed on Jan. 22, 2008, for "False Positive Authentication Types of Authenticable Features and Authentication Areas." The entire disclosure of this provisional application is hereby incorporated by reference into this specification.

This application also claims priority based upon provisional patent application No. 61/063,367, filed on Feb. 4, 2008, for "False Positive Authentication and Single and Multiple Use Documents." The entire disclosure of this provisional application is hereby incorporated by reference into this specification.

This application also claims priority based upon provisional patent application No. 61/065,255, filed on Feb. 11, 2008, for "False Positive Authentication Types of Authenticable Features and Authentication Areas." The entire disclosure of this provisional application is hereby incorporated by reference into this specification.

FIELD OF THE INVENTION

A false positive testing device (FPTD) used to authenticate and verify security printed documents, labels and packages, thus deterring counterfeit, forgery and knockoff attempts of security end products.

BACKGROUND OF THE INVENTION

Historically, security papers and substrates for banknotes, bonds, stocks, coupons, certificates, gift vouchers and other financial instruments along with identification documents, Ids, professional licenses to practice and ownership deeds etc., were ultra violet (UV) dull and did not fluoresce, i.e. turn bright or "glow" under UV light. Thus, UV fluorescent fibers, inks and coatings could be added to the security documents in predetermined target areas for visual verification/authentication by an observer or inspector (Warner, et. al.) Therefore if the above mentioned security documents were to be examined and verified under UV light if said documents turned bright or "glow" which would imply a "negative" result and said documenst would be deemed counterfeit. However, if said documents would remain "dull" or did not "glow" would imply a "positive" result and said documents are to be deemed genuine.

Also, the security substrates contained no fillers (sizing agents) or stiffeners such as potassium iodide starches that allow for authenticity and verification testing by marking on the security document in question, with a commercially available potassium Iodide Based Pen (IBP) or stamp pad in order to turn the marked area to be verified to a gold/amber/yellow color. See, e.g., U.S. Pat. No. 5,063,163 of Carmeli, the entire disclosure of which is hereby incorporated by reference into this specification. Therefore if the above mentioned security documents were to be examined and verified by marking such documents with a commercially available potassium Iodide Based Pen (IBP) turned dark/black/reddish brown would imply a "negative" result and said documents would be deemed counterfeit. However, if said marking on these documents would turn gold/amber/yellow would imply a "positive" result and said documents are to be deemed genuine.

Most commercially available publication grade papers, especially coated papers, have ultraviolet brighteners and sizing agents that render them useless for financial security document applications as they are designed to fluoresce under UV light and they also react to a potassium iodide or potassium permanganate counterfeit detection Iodide Based Pen (IBP)/pad stamps producing a desired and visible colored moiety, usually dark/black/reddish brown in color respectively. Traditionally documents with these results would be considered and accepted as "negative" results and be rejected as "genuine". However, in more recent times, security printers are faced with using recycled papers that often contain unknown percentages of recycled coated publication grade papers mixed with recycled uncoated papers and thus when tested with a potassium iodide or potassium permanganate counterfeit detection Iodide Based Pen (IBP) pens/pad stamps may turn gold/amber/yellow color which signify a "positive" test result or dark/black/reddish brown color which signify a "negative" test result depending on the concentration of recycled coated paper. The same mixture of coated and uncoated recycled papers as above may (which signify a "negative" test result) or may not fluoresce (which signify a "positive" test result) under UV light inspection, depending again on the unknown percentages of coated and uncoated papers present in the recycled substrate.

Using the counterfeit detection Iodide Based Pen (IBP) or stamp pad and UV light detection methods are questionable and subject to "false positive" test errors when the documents are produced on recycled papers. In addition to the above scenario of unknown mixtures of coated versus uncoated paper present in the recycled substrates, many printing papers, such as Japanese rice papers, common newsprint stock, synthetic plastic papers and natural fiber papers contain no UV brighteners nor sizing starches, thus appearing to be UV dull and produce the "false positive" gold/amber/yellow color when tested with a counterfeit detection Iodide Based Pen (IBP).

Sometimes, fraudsters and criminals will take bone fide security documents, such as a one dollar US Banknote, use a oxidizing agent, such as bleach or hydrogen peroxide or a reducing agent such as bisulphite to erase the printed one dollar image, leaving the real security paper substrate to be reprinted at a higher denomination value, a practice known as "raising the note.". Thus the forged note is printed on a bond fide security paper and when tested for potassium iodide starch by a counterfeit detection Iodide Based Pen (IBP) or stamp pad will turn gold/amber/yellow and also looks UV dull under visual examination with a UV light source, a false positive test result.

In extreme cases, counterfeiters, forgers, terrorists, and fraudsters will simply procure the desired real security substrates by "breaking and entry" thus producing counterfeit documents that will produce a false positive test result when examined with a counterfeit detection Iodide Based Pen (IBP) and/or examined with a UV light source. A False Positive Testing Device, FPTD, that is independent of the security paper's UV dull and potassium iodate starch reaction attributes is needed for document, label and packaging authentication and verification.

There are numerous verification/identification commercially available security print technologies/techniques/methods that are used for securing security documents, labels and packages. They range from user friendly low-cost but very effective counterfeit and forgery deterrents such as void pantographs, microprint lines, geometric lathe patterns to covert security features such as scramble indicia to very high tech and expensive features such as radio frequency identification (RFID) tags, holograms, etc., where the verification involves the examination of the distortion or absence of the above mentioned features.

Certain segments of the industry's security end products, such as coupons, checks, cash vouchers, free standing newspaper inserts (FSI), Rx prescription pads etc., warrant using effective but low cost security devices that are easily adopted to the operational production processes in current use for counterfeit/forgery mitigation and subsequent identification and verification.

It is an object of this invention to provide a very effective, low cost user friendly security device that can be used for deterring counterfeit and forgery attempts, is easily adaptable to the manufacturing and printing processes in current use, is most effective in reconciling false positive test results, and provides a new and additional test method for authentication/verification and identification of security documents labels and packages.

SUMMARY OF THE INVENTION

In accordance with one embodiment of this invention, there is provided a false positive testing device (FPTD) used to authenticate and verify security printed documents, labels and packages, thus deterring counterfeit, forgery and knock-off attempts of security end products. The inclusion of FPTD is designed to protect security printed documents against false positive testing results common to counterfeit, forgery and knockoffs etc that are produced on substrate which mimic the same testing results of genuine documents, labels, packages etc.—a "false positive" result such that a gold/amber/yellow color marking with a counterfeit detection Iodide Based Pen (IBP) or stamp pad and/or UV dull when exposed under UV light. The FPTD is composed of a transparent daylight invisible coating that contains a transparent daylight invisible reagent which can be transferred to various types of porous substrates such as paper or board via conventional lithographic offset printing and/or dry offset printing and flexography. The FPTD coating is based on a 100% solids varnish (low volatile organic compounds, VOC's) plus a percentage by weight of transparent reagent, and it uses oxidative—free radical polymerization as the drying mechanism. The FPTD can also contain fluorescent chromaphors which are also transparent and daylight invisible, but fluoresce and/or glow under ultraviolet (UV) light and become visible to an observer. FPTD produces both a "positive" test result such as a gold/amber/yellow color marking with a counterfeit detection Iodide Based Pen (IBP) or stamp pad and/or and UV dull when exposed under an UV light with a "negative" test result such as a dark/black/reddish brown color marking with a with a counterfeit detection Iodide Based Pen (IBP) or stamp pad and/or and UV "bright" when exposed under an UV light.

BRIEF DESCRIPTION OF THE SEVERAL VIEWS OF THE DRAWINGS

The invention will be illustrated by reference to the drawings, in which like numerals refer to like elements, and wherein:

FIG. 1 illustrates typical coupons printed on plain paper after such coupons have been exposed to ultraviolet light and a coupons printed on UV dull paper, such as but not limited to newspaper after such coupons have been exposed to ultraviolet light;

FIG. 2 illustrates typical coupons printed plain on paper after such coupons have been tested with an iodine based detection pen and a coupons printed on UV dull paper such as but not limited to newspaper after such coupons have been tested with a counterfeit detection Iodide Based Pen (IBP);

FIG. 3 illustrates a coupon printed on UV dull paper with a FPTD;

FIG. 4 illustrates the appearance of coupon of FIG. 3 when exposed to ultraviolet light;

FIG. 5 illustrates the coupon of FIG. 3 after it has been marked with a counterfeit detection iodide based pen (IBP) or stamp pad;

FIG. 6 illustrates a certificate with a FPTD;

FIG. 7 illustrates a prescription pad with a FPTD;

FIG. 8 illustrates another prescription pad with a FPTD;

FIG. 9 illustrates a pre-printed security paper with a FPTD;

FIG. 10 illustrates a box with a FPTD;

FIG. 11 illustrates a food stamp coupon check with a FPTD;

FIG. 12 illustrates an identification document with a FPTD; and

DESCRIPTION OF THE PREFERRED EMBODIMENTS

Figure 1:
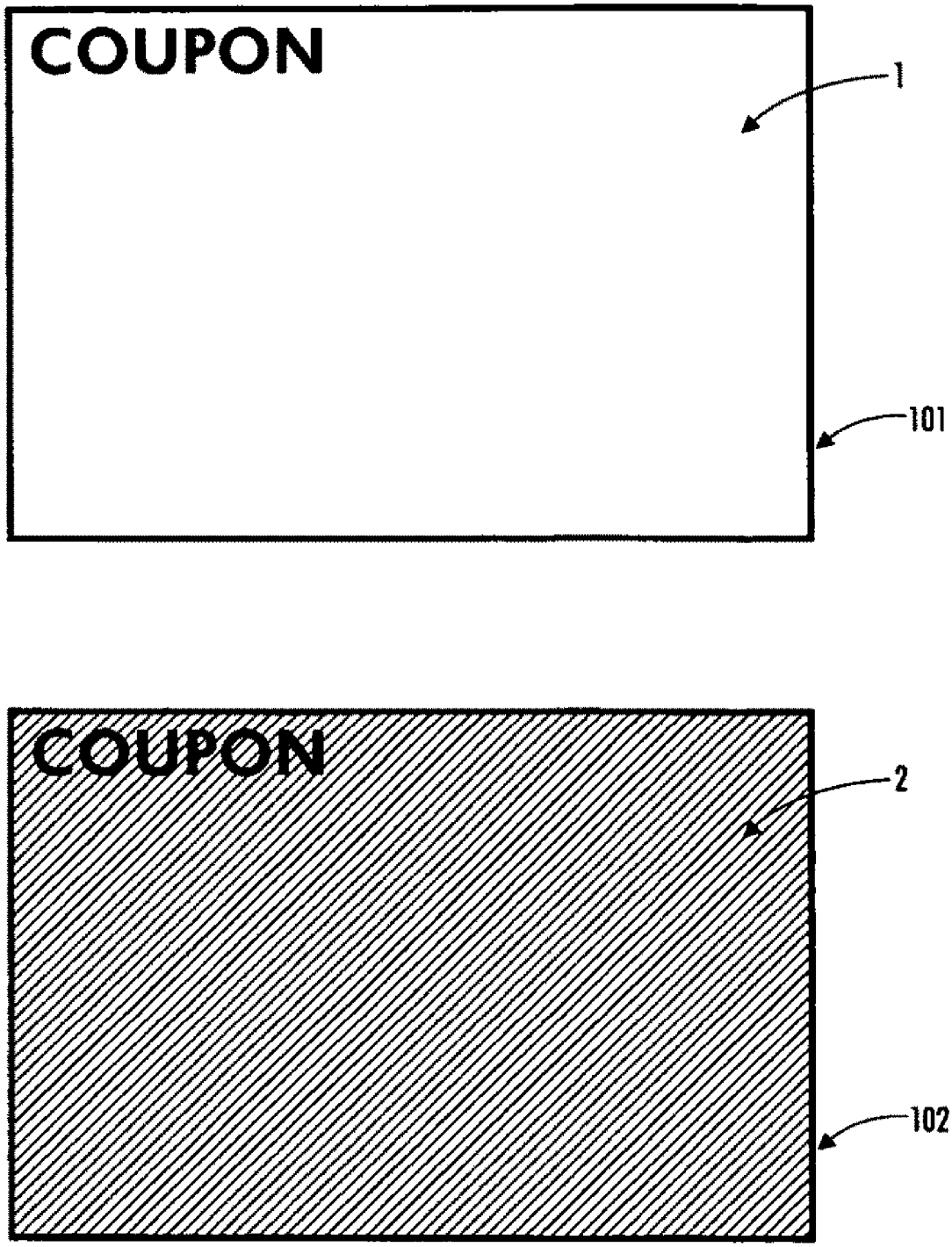
FIGS. 1-12, illustrate how the FPTD can be employed to reconcile false positive test errors on counterfeit documents, fraudulent financial instruments, labels and packages.

The false positive testing device (FPTD) illustrated in the drawings is preferably a transparent daylight invisible security printable coating ("A") that, in one embodiment, is composed of a hundred percent (100%) solids low volatile organic compound, VOC doped with a reagent at concentration levels ranging from tent to thirty percent (10 to 30%) by weight. The coating can be transferred to a substrate (such as, e.g., paper, board or label stock) using conventional sheet fed or web-offset lithographic printing presses equipped with conventional fountain solution, dampeners because such coating uses oxidative-free radical polymerization for setting and drying. Reference may be had, e.g., to "Chemistry for the Graphic Arts," Second Edition, Eldred, Nelson R, 1992, ISBN: 0-88362-149-5, pp 237, & 245, PIAGATF Press—Sewickley, Pa.

In one embodiment, the FPTD contains one or more fluorescent chromaphors such as, e.g., a styrene component of an alkyd resin, in which case the FPTD remains daylight invisible but becomes visible and "glows" under ultra violet (UV) light, for additional authentication and verification test.

After the FPTD coating is imaged and printed onto a chosen paper/board substrate, an observer can draw/write/apply on the coating with a potassium—iodide based pen (IBP)/stamp pad or a potassium—permanganate based pen/stamp pad thus transferring a redox solution ("S") to the coating ("A") and producing a chemical reaction to form a desired visible colored moiety ("C"), usually a dark/black/reddish brown mark. Reference may be had, e.g., to "Optical Document Security," Second Edition, Renesse, Rudolf L. van, 1998, ISBN: 0-89006-982-4, pp 117-124, Artech House, Boston—London.

Because the FPTD coating is a 100% solids, low VOC, coating and dries via oxidative—free radical polymerization, it can be transferred to a printing substrate via the conventional lithographic process where conventional printing plates are receptive to both oleophilic inks and coatings (image areas) and simultaneously receptive to hydrophilic fountain solutions (non image areas). Thus, the FPTD in this invention can be imaged and transferred to the printing substrate via conventional offset lithography, sheetfed or web offset printing, dry lithography and/or flexographic processes.

Another advantage of using a 100% solids coating for the FPTD is that it dries by oxidation-free radical polymerization; and when it is written/applied on with a counterfeit detection Iodide Based Pen (IBP), no molecular transfer of the reagent in the transparent daylight invisible coating ("A") transfers to the IBP writing tip. Consequently, the FPTD does not foul the counterfeit detection Iodide Based Pen (IBP)'s ability to successfully mark the coating ("A"), an undesirable incident that occurs when using conventional high VOC content inks and coating which renders the test procedure useless.

For the oxido reduction to take place successfully (i.e., for the reagent in the coating "A" to be reduced to a colored and visible moiety "C"), the coating must be dry before it is tested with the counterfeit detection pen solution ("S"). If the coating is marked on with the IBP before it dries, a molecular transfer of the reagent in the coating is transferred to the pen and renders the test procedure useless as subsequent markings by the fouled pen leave unwanted false positive or negative visible colored marks on the test target and or security substrate.

There are other commercially available pen reactive marking systems available. Reference may be had, e.g., to Technical Data Sheet—"Pen Reactive Inks" Dry Offset/Letterpress-SCIPA Securinx Corp. 8000 Research Way, Springfield, Va., 22153, USA. Reference also may be had to published United States patent application 2005/0106363 A1, the entire disclosure of which is hereby incorporated by reference into this specification.

Published United States patent application 2005/0106363A1 claims, in claim 1 thereof: "1. An improvement in a coupon printed on non-currency grade paper for authenticated redemption at a retail store, the improvement comprising: a coating having a trace chemical residual content different than the non-currency grade paper, the trace chemical residual content operative to react with a chemical solution such that the chemical solution changes color differently in response to contact with the non-currency grade paper than in response to contact with the coating."

Published U.S. patent application 2005/0106363A1 describes a curable coating. Thus, in paragraph [0023] of this publication (see page 3), it is disclosed that: "To manufacture the coupon, a printed coupon is provided using either a sheet fed or web fed printing process. The coating, such as a UV/EB coating, is added to the printed coupon. Alternatively, the coating is added to the coupon paper prior to printing of the coupon. In one embodiment, the coating is added using a flexo process. For example, a rubber plate on a rotary device places the coating on the paper. The paper and applied coating are then dried, such as by using ultraviolet or electron beam curing. Other now known or later developed drying processes may be used. In one embodiment, a glue unit or a coater unit are used for a flexo process. Where a patterned coating is provided, the rubber plate of the flexo device is patterned using photo exposure or other now known or later developed techniques. A blanket coating may also be used, such as for applying the coating without patterning in a flexo device. In an alternative embodiment, the coating is applied with an ink fountain, such as a lithography tower or ink roller. One or more of the ink fountains in a lithography printing press applies the coating in a pattern or uniform sheet. Either of an oil- or a water-based ink fountain may be used. To avoid decreasing the number of colors or inks available for use in printing a coupon, the flexo device is used. In yet other alternative embodiments, intaglio with etched plates is used for applying the coating or printing rather than the emulsion provided by the lithography device. Other now known or later developed processes and devices for applying ink or coatings may be used in either of web or sheet fed printing presses. In an alternative embodiment, the coupon 12 is impregnated with the material."

Such published U.S. patent application 2005/0106363 describes a process in which an ultraviolet (UV) or electron beam curable coating is applied to a target or verification area on a coupon either before or after the coupon is printed. The coating contains a trace residual content (see, e.g., paragraphs [0025] and [0027] that is either lower or higher than the concentration of the same reagent inherent in the paper used for printing the coupon. Thus, when the coating is marked with a commercially available counterfeit detection pen (see paragraphs [0027] and [0028]-, it changes to a color that is different than produced on the non-coated areas of the coupon, resulting in either a lighter or darker colored mark.

The other commercially available pen reactive marking systems described hereinabove do not work using conventional lithographic printing systems, where as the FPTD does work well with conventional offset lithographic and oxidation-free radical polymerization drying systems. Thus, applicants provide a daylight transparent invisible coating that can be imaged and printed on paper or board stock using conventional lithographic practices of offset lithographic sheetfed and web offset printing, and also imaged and printed using dry offset or flexographic printing processes.

The FPTD eliminates testing errors (false positive test errors) associated with the lack of potassium iodide-starch content a property most typically found in security printing substrates, along with their lack of UV brighteners or UV dull test characteristics.

The FPTD can be imaged and transferred to the security document, label or package overtly or covertly for subsequent validation by applying a counterfeit detection Iodide Based Pen (IBP) and/or UV light source for authentication verification and the elimination of false positive test results.

The FPTD is a very effective and low cost security printing device that can be easily adapted into current manufacturing operations without modification to the printing process. It is user friendly and easily tested for verification and authentication of security documents, labels and packages.

Because the FPTD coating is transparent and daylight invisible, it can be coated over a preprinted colored comparison image. If the document, label or package being tested for authentication and verification is genuine, then the printed colored image will match the same color of the false positive test image when the FPTD coating is activated by the counterfeit detection Iodide Based Pen (IBP). This allows for visual observation and comparison testing against a predetermined color standard by an inspector or for authentication/verification using machine readable inspection technologies employing colorimetry and/or spectrophotometry type instrumentation.

The FPTD also allows for what can be termed as a "Dual or Multi Factor" (or more the one) Authentication, where a "false positive" (a gold/amber/yellow mark and/or UV dull) and a "deliberate negative" (dark/black/reddish brown mark and/or "glow" under UV) reactions are elicited at the same time. This is accomplished by including or excluding the reagent in the transparent daylight invisible security printable coating and also controlling the placement/position of said coating on a document. This is done so one can establish and control the necessary reactions independent to the reaction one would get during the authentication process coming from different substrates and various inks/coating/varnish/toners used in creating the document. Especially, when it pertains to available substrate since one may or may not be able to control the present of or the amount of UV brighteners and sizing agents in the substrate which can draw a undesired "false positive" (a gold/amber/yellow mark and/or UV dull) reaction.

By taking advantage of the known reaction properties from different substrates and various inks/coating/varnish/toners in the way they react in the authentication protocols (such as exposure to a counterfeit detection Iodide Based Pen [IBP] and/or examined under a UV light source that will result in either a "false positive" [a gold/amber/yellow mark and/or UV dull] and a "deliberate negative" [dark/black/reddish brown mark and/or "glow" under UV] reactions), one can control the degree of (such as the permanency of the mark) and/or types of reactions (such as a "false positive and/or "deliberate negative") from the authentication protocols, thereby allowing for a very powerful set of anti-counterfeit authentication scenarios.

One example of such authentication scenario is to used the "false positive" (a gold/amber/yellow mark and/or UV dull) and a "deliberate negative" (dark/black/reddish brown mark and/or "glow" under UV) reactions to detect hidden features such as but not limiting to scripts, codes, patterns, graphics, logos and serial numbers. Another scenario is to used permanency of the markings by the exposure to a counterfeit detection Iodide Based Pen (IBP) to create an anti-copy defense against (but not limited to) re-use or copying since the documents with said FPTD may be permanently marked (i.e does not fade with time) when authenticated/verified.

Once the FPTD has been coated onto a desired substrate (via conventional lithographic offset, dry offset or flexography) in a predetermined target area, the FPTD can be tested with a commercially available counterfeit detection pen (or stamp pad), generally containing potassium iodide-starch or potassium permanganate and a desired visible colored reaction or molecular complex results. At that point, the observer can observe with the unaided eye, the colored FPTD for verification and authentication of the document, label or package. Further investigation can be made under UV radiation for the presence or absence of fluorescence.

Thus, even if the counterfeiters or fraudsters have access to bone-fide security paper or substrates that mimic security papers (that is they have no UV brighteners [UV dull under UV light], and/or no reagent content [thus non counterfeit pen reactive]), the FPTD excludes these substrate properties and eliminates false positive test error on counterfeit/forged documents, packages and labels. The FPTD overcomes the false positive test that can occur on counterfeit documents, packages and labels when criminals have access to printing substrates that mimic the security attributes of no reagents and UV dull visual properties.

FIG. 1 illustrates a coupon 1 printed on regular plain paper 101, and it also illustrates a coupon 2 printed on UV dull paper 102 (such as, e.g., newspaper) when said coupons 1 and 2 are exposed under an ultra violet (UV) light (not shown). Coupon 1 will glow or fluoresce (recognized and accepted a negative reaction), and coupon 2 will remain dull (recognized and accepted as a positive reaction), which is similar to the reaction of real currencies and UV dull security paper.

Figure 2:
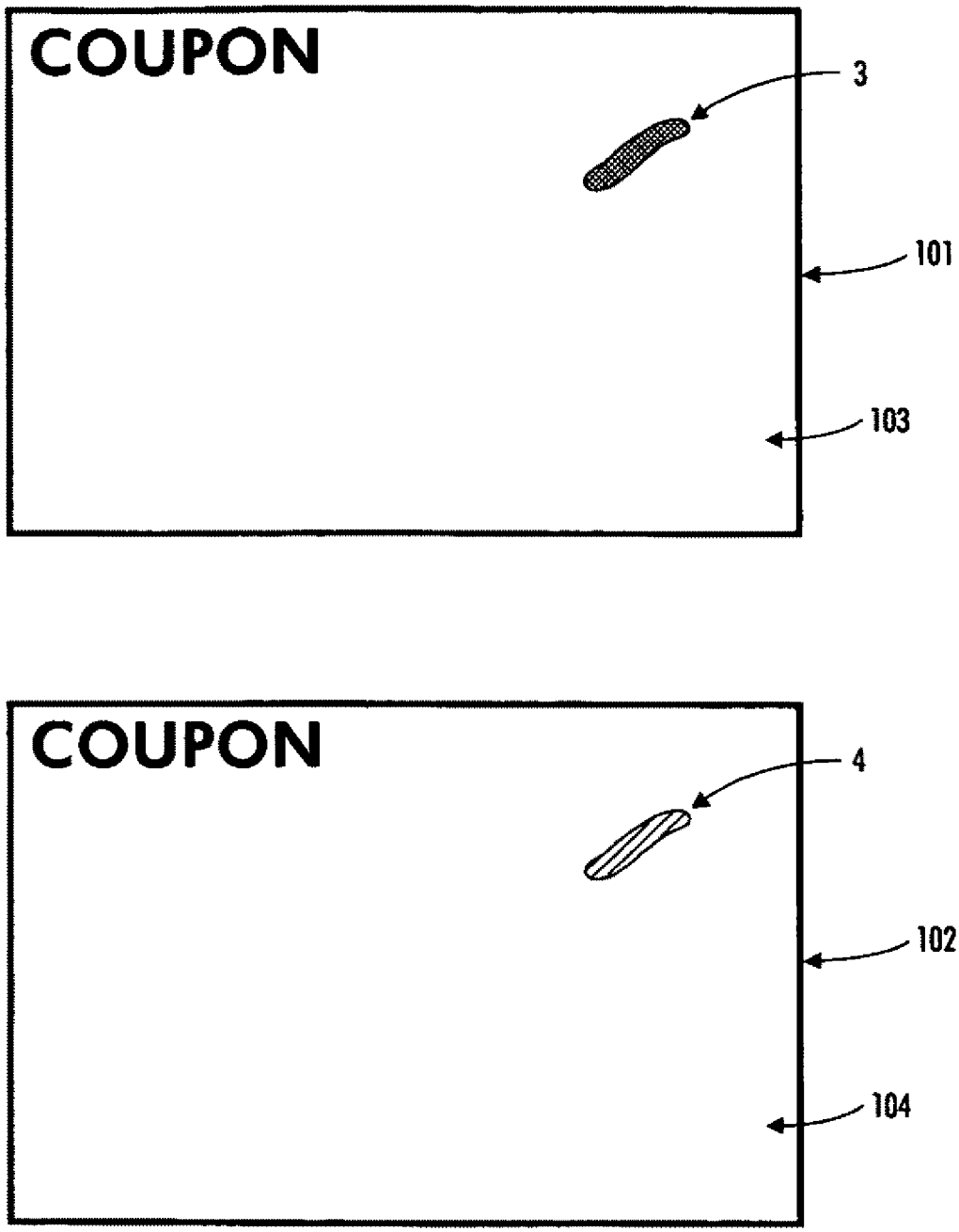

FIG. 2 illustrates a coupon 103 printed on regular plain paper 101, and it also illustrates a coupon 104 printed on newspaper 102, when said coupons 103 and 104 are tested with a counterfeit detection Iodide Based Pen (IBP) or a stamp pad. The mark 3 made by the counterfeit detection Iodide Based Pen (IBP) is a dark/black/reddish brown mark (a recognized and accepted negative reaction) on the coupon 103 printed on plain paper 101, whereas the mark 4 made by the counterfeit detection Iodide Based Pen (IBP) is a gold/amber/yellow mark (recognized and accepted as a positive reaction) on the coupon 104 printed on newspaper 102.

Figure 3:
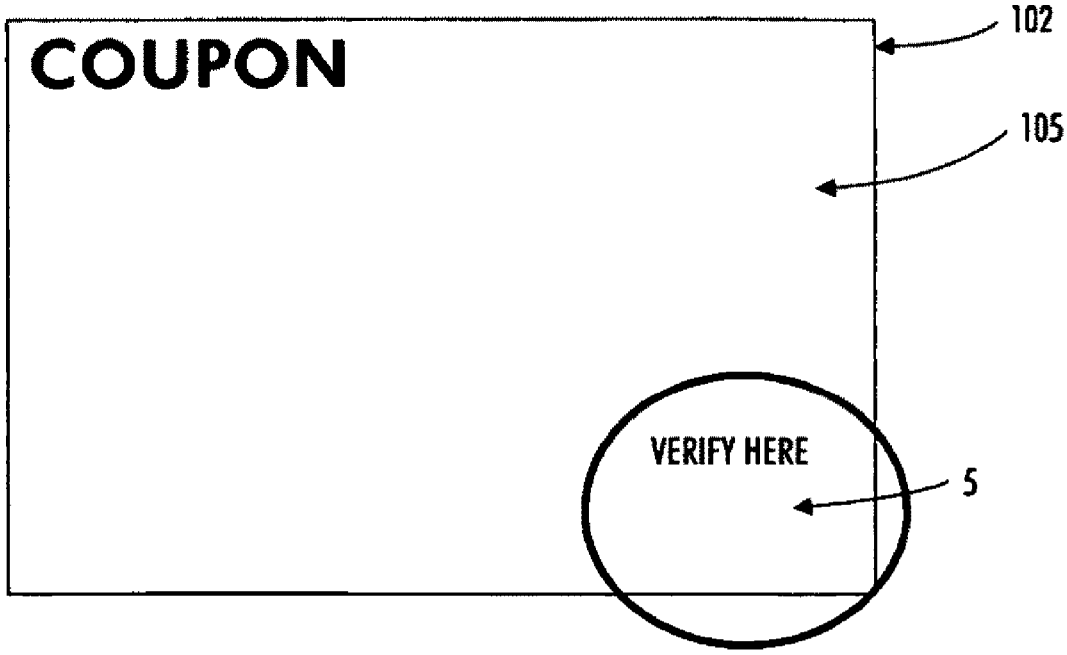

FIG. 3 illustrates a coupon 105 printed on UV dull paper 102 (such as, e.g., newspaper, Japanese rice paper, etc.) where element 5 is the False Positive Test Device ("FPTD") which acts as a security device and means for detecting counterfeit products being produced on real security papers or substrates to mimic UV dull and starch free which will produce a false positive reaction when tested with a counterfeit detection Iodide Based Pen (IBP) or stamp pad and an Ultra Violet (UV) light source.

Figure 4:
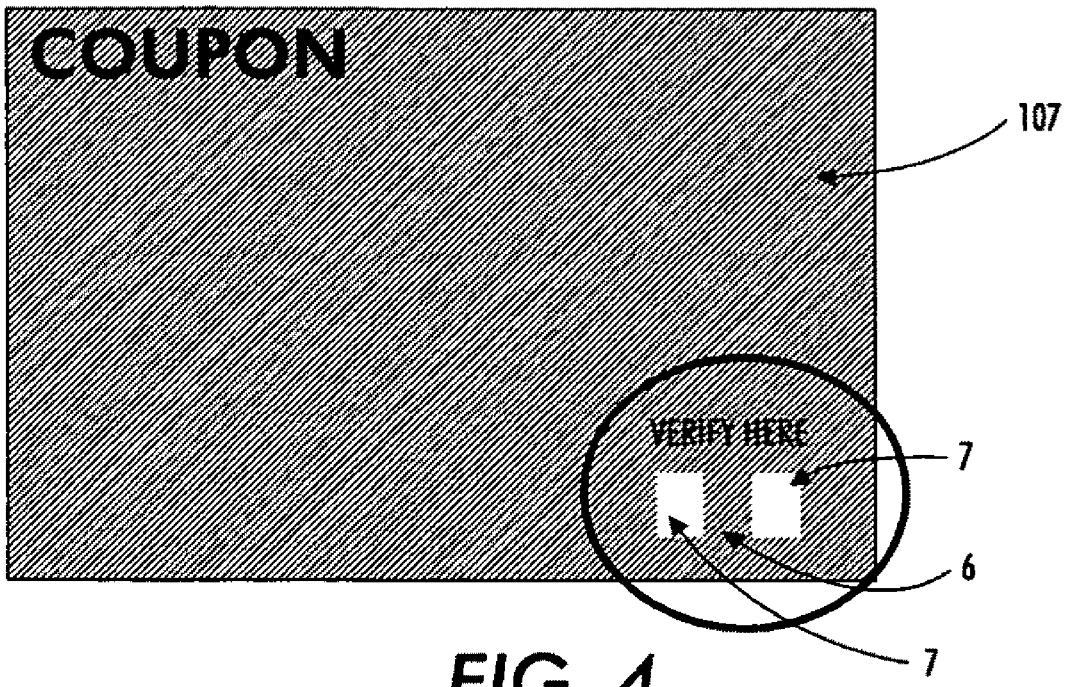

FIG. 4 illustrates what occurs when coupon 105 is exposed to an ultraviolet light source (not shown) to produce coupon 107. The coupon 107 "reacts dull" and will not fluoresce or glow (c.f. coupon 2); however, within the FPTD 5, several reactions will occur. Thus, referring to FIG. 4, it will be seen that area 6 FPTD will fluoresce or "glow" (a deliberate negative reaction) and area 7 of the FPTD will remain dull (a false positive reaction).

Figure 5:
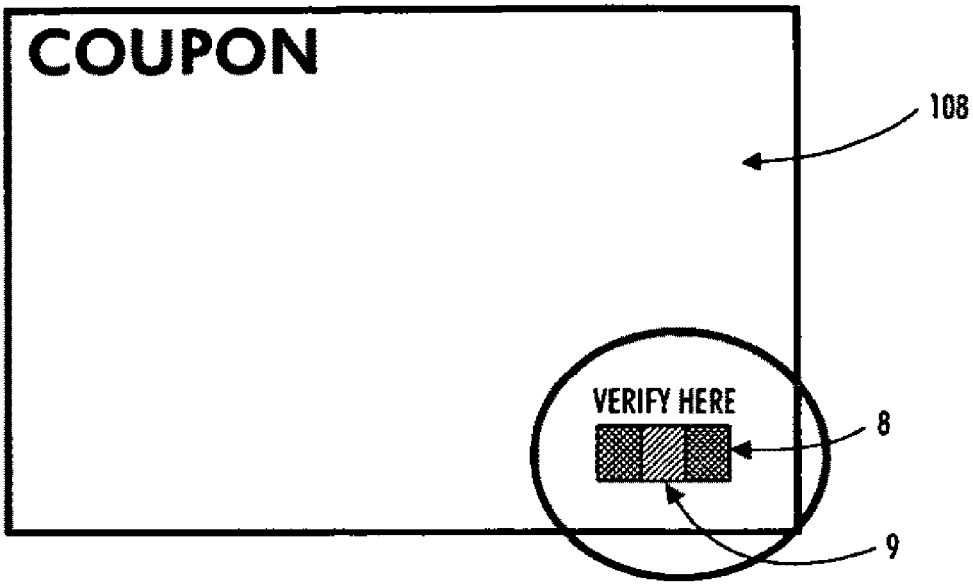

FIG. 5 illustrates what occurs when the coupon 105 (see FIG. 3) is marked with a counterfeit detection Iodide Based Pen (IBP) or stamp pad, within an FPTD that contains a transparent daylight invisible security printable coating. The coupon 108 will evidence reaction 8 (because of the mark made by the counterfeit detection Iodide Based Pen [IBP] or stamp pad which is a dark/black/reddish brown mark [a deliberate negative reaction]), and it will also evidence reaction 9 (because of the mark made by the counterfeit detection Iodide Based Pen which is a gold/amber/yellow mark [a false positive area]). These phenomena are preferably accomplished by including or excluding the active reagent in the transparent daylight invisible printable coating and also by controlling the placement/position of said coating on a document.

Figure 6:
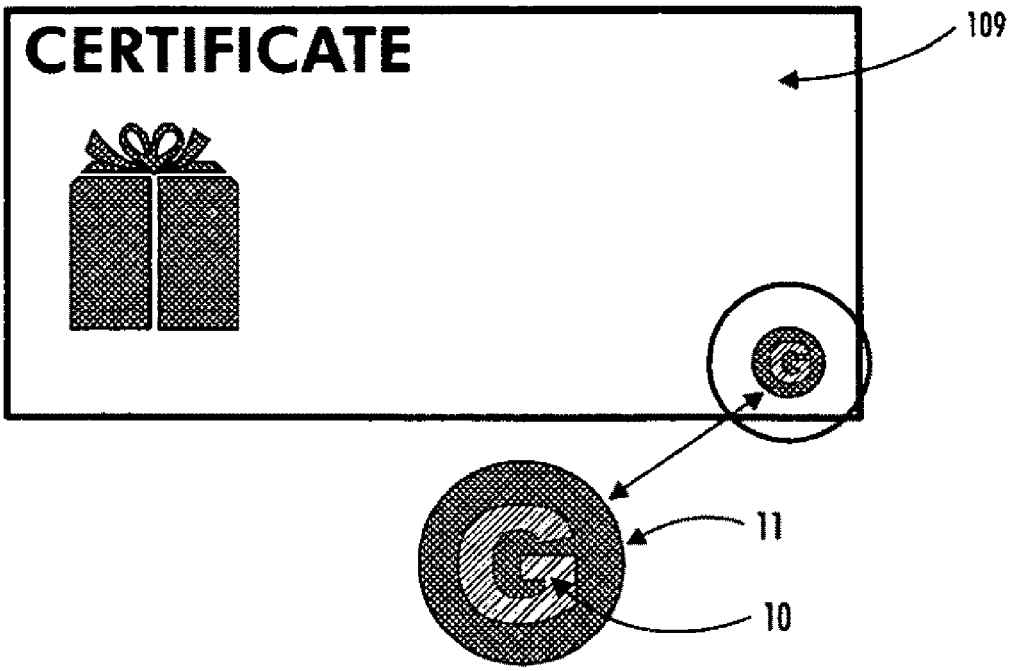

FIG. 6 illustrates a certificate 109 with a FPTD that uses a graphic logo "G" as the false positive area shown as 11, a gold/amber/yellow mark, and 10 is the deliberate negative area as a dark/black/reddish brown mark when the FPTD is marked by counterfeit detection Iodide Based Pen (IBP) or stamp pad. By taking advantage of the known reaction properties of the substrates, inks/coating/varnish/toners and the transparent daylight invisible security printable coating coupled with the placement/position of said inks/coating/varnish/toners and the transparent daylight invisible security printable coating on a document, the "false positive" (a gold/amber/yellow) mark and a "deliberate negative" (dark/black/reddish brown) mark is used to create the hidden feature "G".

Figure 7:
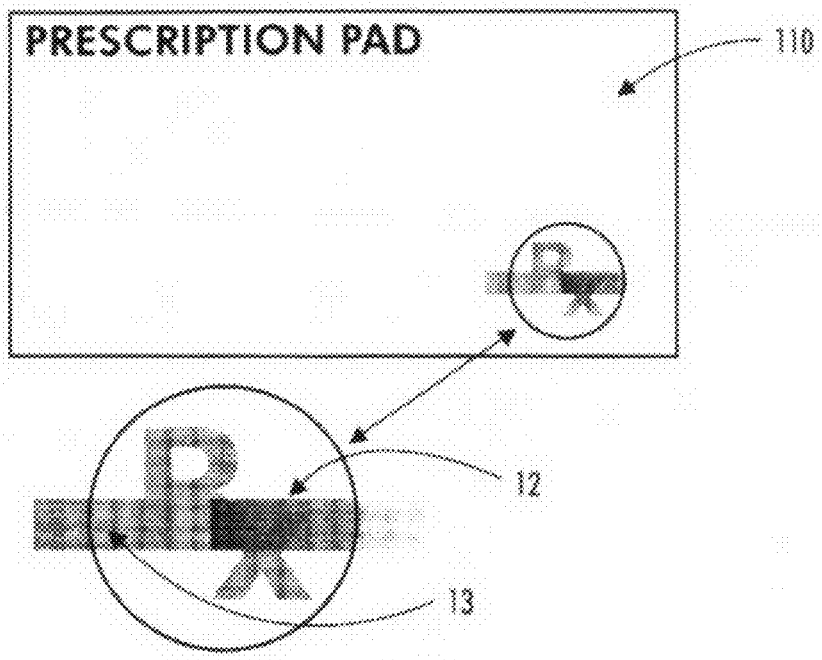

FIG. 7 illustrates a prescription pad 110 with a FPTD that contains both a false positive area (shown as 13 a gold/amber/yellow mark and 12 as the deliberate negative area as a dark/black mark when the FPTD is marked by a counterfeit detection Iodide Based Pen (IBP).

Figure 8:
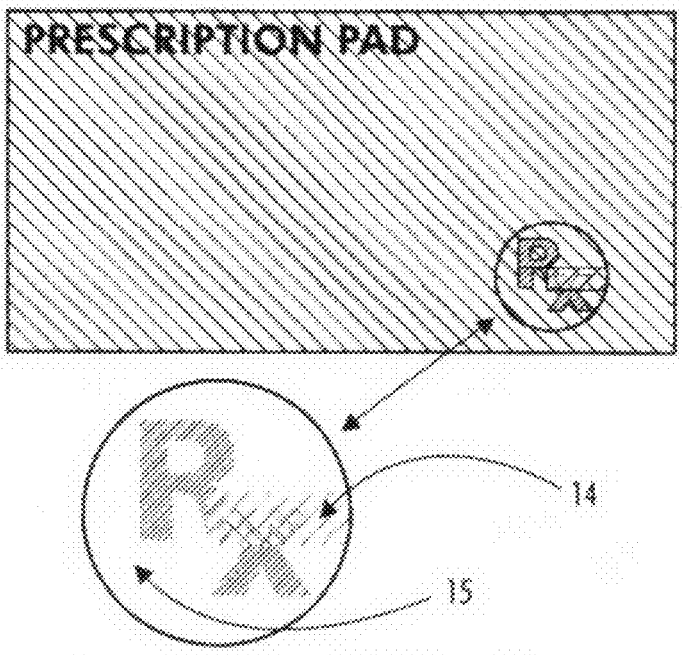

FIG. 8 illustrates a prescription pad 111 with a FPTD that contains both a "false positive" area which will react dull and will not fluoresce shown as 15 and 14 as the "deliberate negative" area which will fluoresce or "glow" when the FPTD is exposed under a UV light (not shown).

Figure 9:
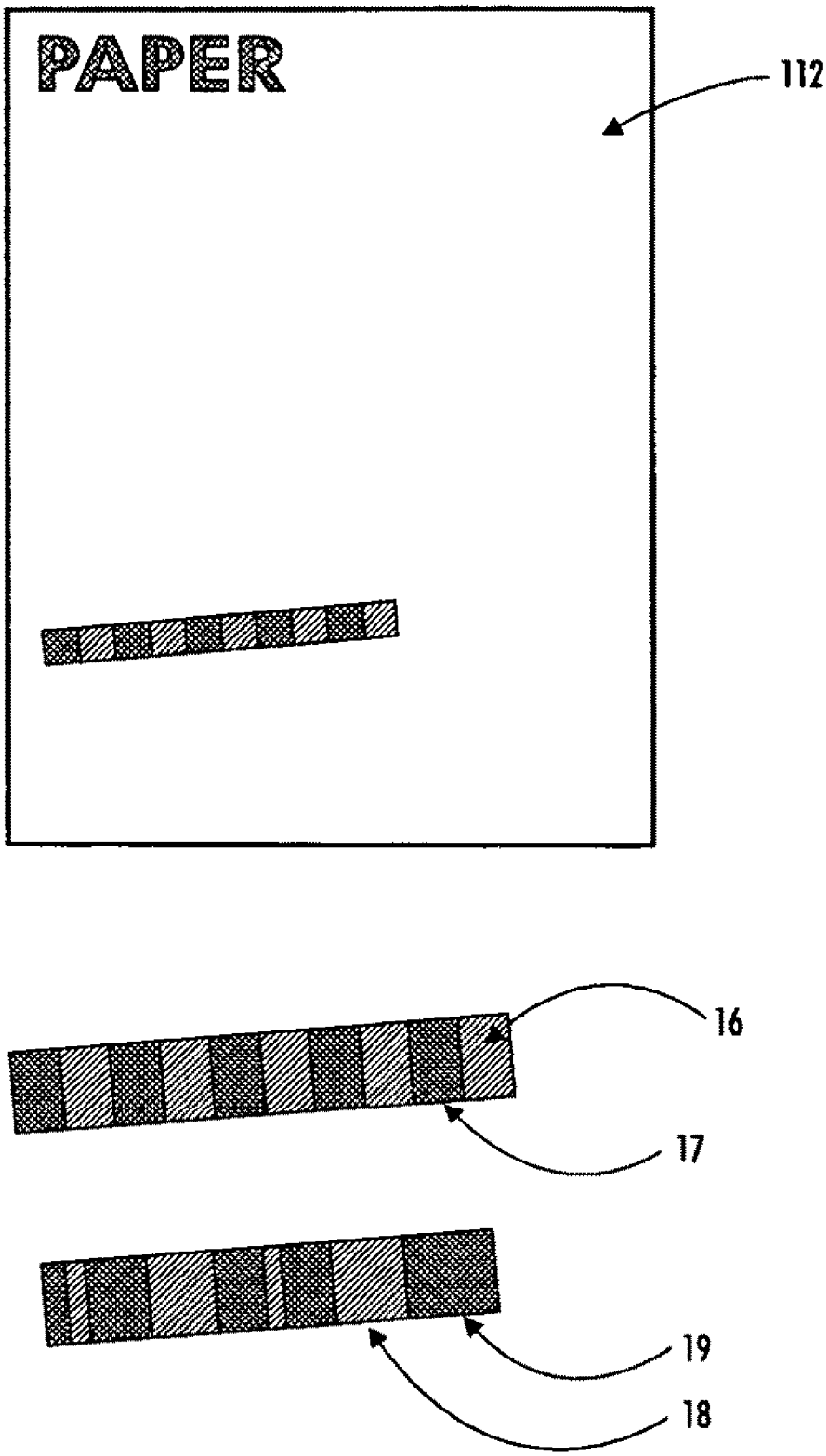

FIG. 9 illustrates a pre-printed security paper 112 with a FPTD both a "false positive" areas shown as 16 and 18 as gold/amber/yellow marks with 17 and 19 as the "deliberate negative" areas as a dark/black marks when the FPTD is marked by and counterfeit detection Iodide Based Pen (IBP). In this example, the FPTD can also be designed as a grid or code as to further encode the document thereby relating a code on the substrate to the actual issued content (such as the text) of the issuing document.

Figure 10:
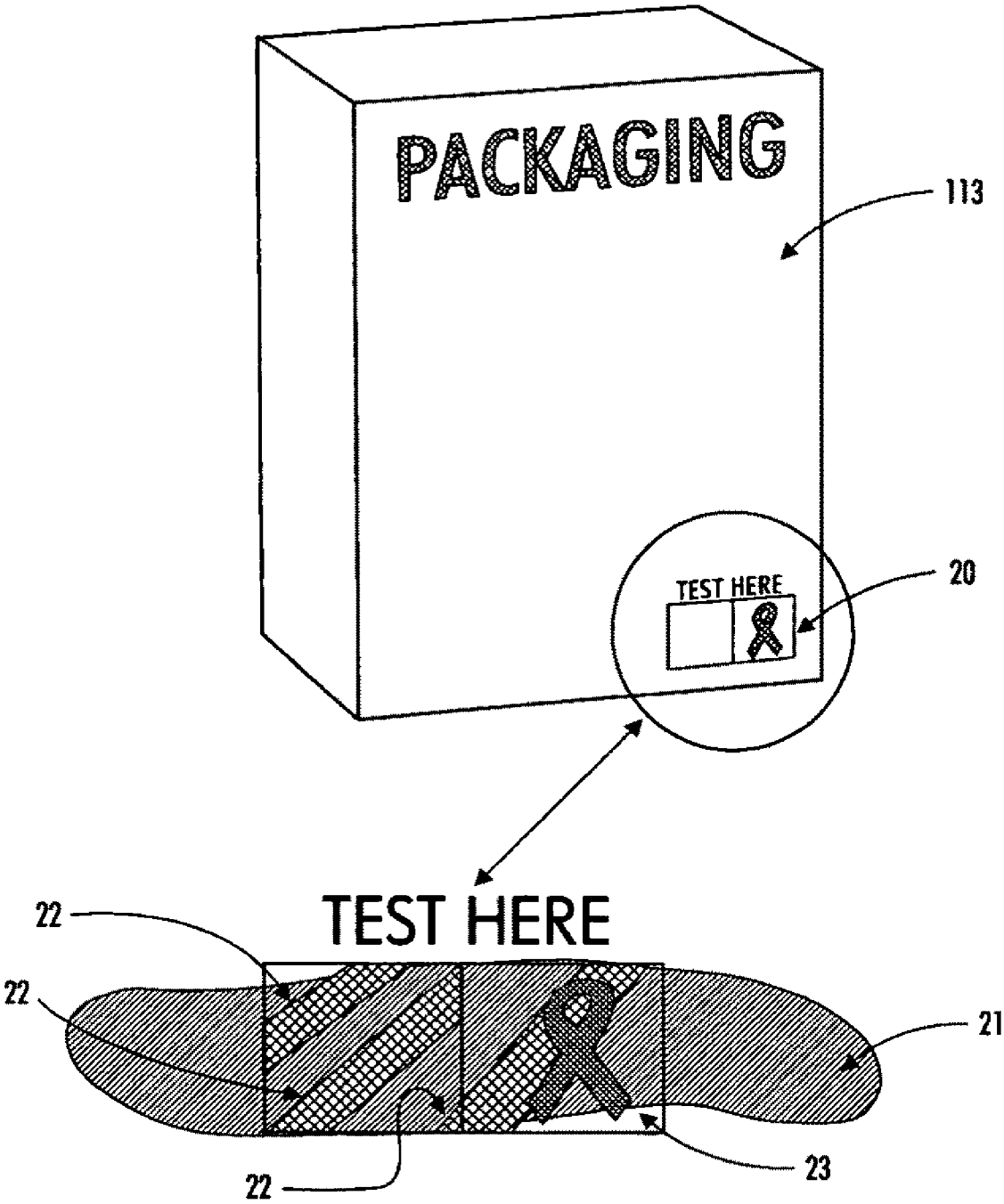

FIG. 10 illustrates a packaged box 113 with a FPTD shown at 20 in it's unmarked or unverified state, that contains both a "false positive" areas shown as 21 a gold/amber/yellow marks and 22 as the "deliberate negative" area as a dark/black marks when the FPTD is marked by and IBP and 23 as areas unmarked by the counterfeit detection Iodide Based Pen (IBP) or stamp pad.

Figure 11:
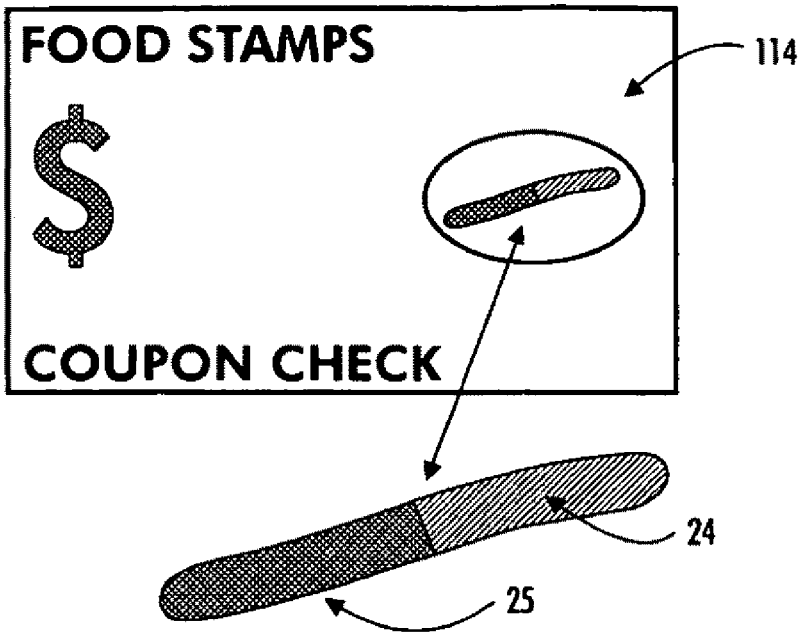

FIG. 11 illustrates a food stamp coupon check 114 with a FPTD that contains both a "false positive" area shown as 24 a gold/amber/yellow mark and 25 as the "deliberate negative" area as a dark/black mark when the FPTD is marked by and IBP. Both the gold/amber/yellow and dark/black marks can remain on the document after verification which will result in a single use document since the mark on the verified document will impede or prevent the reuse of said document.

Figure 12:
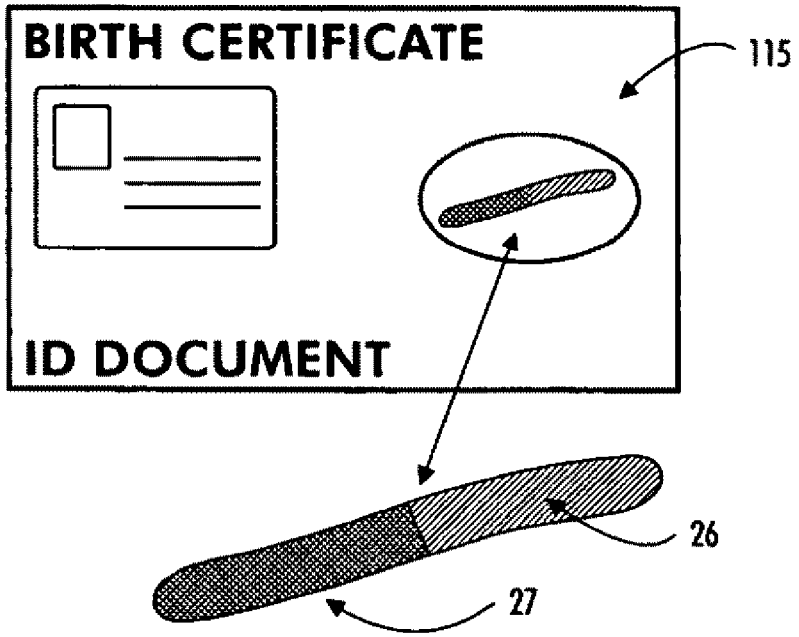

FIG. 12 illustrates an identification document 115, such as a birth certificate, with a FPTD that contains both a "false positive" area shown as 26 a gold/amber/yellow mark and 27 as the "deliberate negative" area as a dark/black mark when the FPTD is marked by and counterfeit detection Iodide Based Pen (IBP) or stamp pad. Both the gold/amber/yellow and dark/black marks can fade off the document after verification in minutes/hours/days/years which will allow for multiple use of said document.

Figure 13:
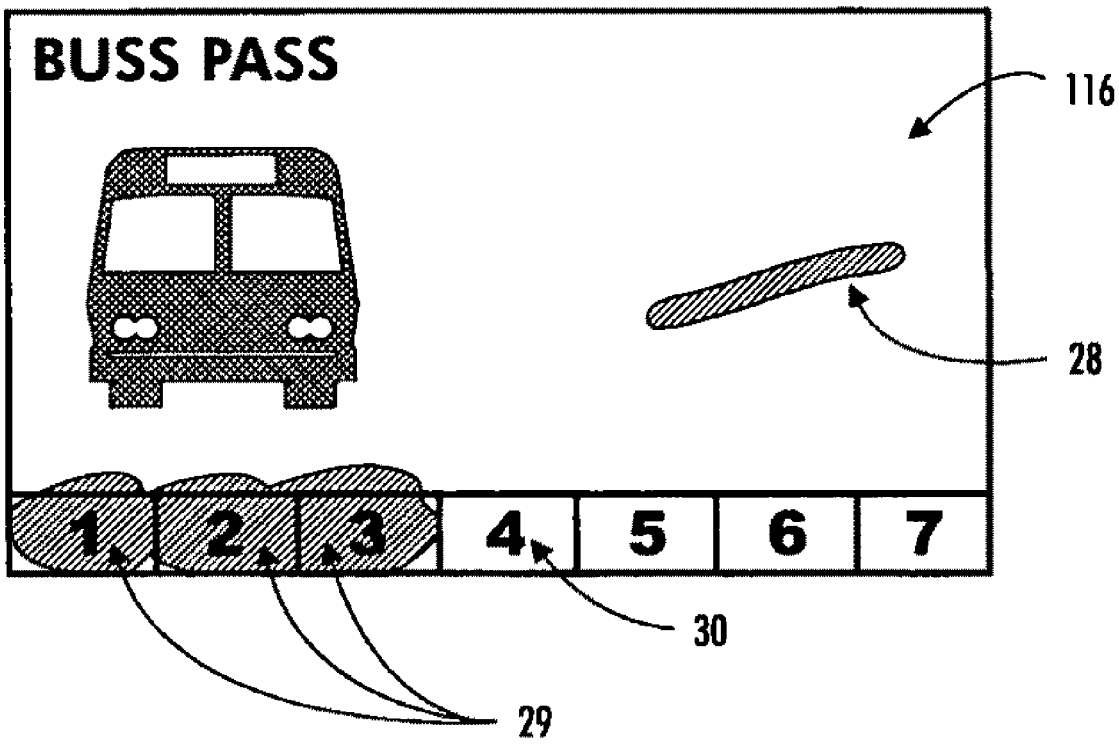
FIG. 13 illustrates a multiple use document with a FPTD.

FIG. 13 illustrates a multiple use document 116, such as a bus pass, with a FPTD that contain "false positive" areas shown as 28 and 29 that, when marked or verified with a counterfeit detection Iodide Based Pen (IBP) or stamp pad, will cause a gold/amber/yellow mark to appear. However, the FPTD in 28 will fade in minutes/hours/days/years which will allow for multiple verification of said document however, 29 where the gold/amber/yellow are permanent marks on the document. 30 represents areas not yet verify or tested by the counterfeit detection Iodide Based Pen (IBP) or stamp pad Applicants' invention differs from the invention disclosed in published U.S. patent application 2005/0106363. The latter invention uses a coating(s) that must be dried by either UV or electron beam, EB, radiation. It is well known (Chemistry for the Graphic Arts—2$^{nd}$ ed., Eldred, pp 237-238) that these types of drying systems are formulated with oligomers, reactive diluents, and in the case of UV coatings oligomers and photo-initiators are used to initiate the drying process when exposed to either UV or EB radiation. These types of drying systems require addition of extra UV and/or EB drying units and are usually found in high volume package printing applications. The above invention using UV/EB coatings will not work with conventional oxidation-free radical polymerization drying systems used in conventional lithographic low VOV (100% solids) coatings described in the present FPTD invention.

Furthermore, as is apparent from US 2005/0106363A1 patent application, for the proposed coating of such published application to work successfully, the concentration of the reagent in the coating (see paragraph [0028] and claims 1 and 6), must be either greater than or less than the concentration of the same reagent inherent in the coupon substrate. This requires that one must have either a priori knowledge of the percent reagent in the coupon paper substrate or, alternatively, submit the coupon paper stock to laboratory analysis to determine the percentage and type of trace reagent present prior to adjusting the concentration of the same reagent needed in the coating for subsequent testing. This is not a practical option for most coupon printers, nor do most coupon printers have UV/EB drying capabilities on their production sheetfed/web offset lithographic presses.

Applicants' FPTD preferably uses a 100% solids low VOC coating, it requires no additional drying processes or equipment such as UV or EB drying mechanisms, and it relies on oxidation-free radical polymerization. The present FPTD works irrespectively of the reagent concentrations present or missing in any selected substrate, thus providing a true test result regardless of the reagents' percentages associated with mixtures of recycled coated and uncoated stocks, or the lack of reagents inherent in bone fide security papers or substrates that mimic security papers, thus eliminating false positive test results.

U.S. Pat. No. 5,063,163, Carmeli, the entire disclosure of which is hereby incorporated by reference into this specification, discloses a "Method of Detecting Counterfeit Currency." The method of this patent is disclosed in column 2 of the patent, wherein it is stated that: "The unique method of the present invention for detecting counterfeit paper currency generally includes applying a test solution which detects the content of starch in the currency paper. The solution, which is light golden-brown in color, when applied to a counterfeit paper currency, forms a bluish-black complex with starch. On the other hand, the color of the test solution does not change in the case of a genuine paper currency, perhaps due to the absence of the counterpart starch molecules required for forming the bluish-black complex."

It is also disclosed in such column 2 that "The test solution is a reagent solution containing iodine and a suitable solvent, preferably selected from the group consisting of alcohol, carbon disulfide, chloroform, ether, carbon tetrachloride, glycerol, and an alkaline iodide solution. The alkaline iodide may preferably be selected from the group consisting of sodium iodide and potassium iodide. In particular, the light golden-brown test solution contains about 0.5% to about 2.0% iodine, about 48.0% to about 49.5% water, and about 44% to about 50% alcohol by volume of the reagent solution. The solution may also contain up to about 6% of a bleaching agent, such as hydrogen peroxide, by volume of the solution. It should be noted that various percentages of the noted ingredients may be altered in order to provide various test solutions of varying strengths. The main component of the test solution is the iodine element and, therefore, other types of reagents may also be used than those listed herein order to produce an iodine solution for use in the method of this invention."

It is also disclosed in such column 2 that: "As shown in FIG. 3, the method includes applying the test solution to a paper currency and after a short time delay, i.e., almost immediately to a few seconds, the color of the test area is compared with a predetermined standard (defined below). If the currency is a genuine paper currency (FIG. 1), no color change of the test solution area 10 on paper currency A will be observed. On the other hand, in the case of a counterfeit currency (FIG. 2), the color of the test composition area 12 on the paper currency B will change from light golden-brown to bluish-black or substantially black."

None of the prior art patents describe hereinabove disclose the the unique low VOC 100% solids coating used in the FPTD and its applications for conventional lithographic sheetfed and web offset printing to eliminate false positive test results from counterfeit or forged documents, labels and packages.

What is claimed is:

1. A false positive testing assembly comprising:

a false positive testing device disposed on a porous substrate, wherein said device comprises a) a first section including transparent, daylight invisible, one hundred percent solids, low volatile organic compound, oxidative free radical polymerized varnish doped with a transparent reagent, wherein said reagent is present in the range of 10% to 30% by weight of said device, wherein said reagent chemically reacts with a redox solution to form a visible colored moiety on said substrate, and b) a second section including transparent, daylight invisible, one hundred percent solids, low volatile organic compound, oxidative free radical polymerized varnish excluding said reagent, wherein said first section provides a negative result and turns dark/black/reddish brown when marked with a iodide based pen, and said second section is contiguous to said first section and provides a positive result and turns gold/amber/yellow when marked with said iodide based pen, and wherein said false positive testing device works irrespective of the reagent concentrations present in the underlying substrate.

2. The assembly as recited in claim 1, wherein said negative result takes the form of an indiciium selected from the group consisting of a logo, graphic art, an information block, or mixtures thereof.

3. The assembly as recited in claim 1, wherein said positive result and/or said negative result is a permanent mark.

4. The assembly as recited in claim 1, wherein said positive result and/or said negative result is a temporary mark that fades and disappears over time.

5. The assembly as recited in claim 1, wherein said device is comprised of fluorescent chromaphors.

6. The assembly as recited in claim 1 wherein, when said device is exposed to ultraviolet light, said device produces both a positive result and a negative result.

7. The assembly as recited in claim 6, wherein said positive result is an ultraviolet dull area.

8. The assembly as recited in claim 7, wherein said negative result is an ultraviolet fluorescent area.

9. A process for applying a false positive testing assembly to a porous substrate, wherein said process comprises:

printing a mixture of fountain solutions (aqueous) and varnishes with a planographic printing plate on the porous substrate to differentiate between non-image areas formed by the fountain solutions and image areas formed by the varnishes respectively, wherein said varnishes form a false positive testing device and include:

a) daylight invisible, one hundred percent solids, low volatile organic compound, oxidative free radical polymerized varnish doped with a transparent reagent, wherein said reagent is present in the range of 10% to 30% by weight of said device, wherein said reagent chemically reacts with a redox solution to form a visible colored moiety on said substrate and turns dark/black/reddish brown when marked with a iodide based pen; and b) daylight invisible, one hundred percent solids, low volatile organic compound, oxidative free radical polymerized varnish excluding said reagent which turns gold/amber/yellow when marked with said iodide based pen, wherein said false positive testing device works irrespective of the reagent concentrations present in the underlying substrate.

* * * * *